United States Patent [19]

Kane

[11] Patent Number: 5,055,077

[45] Date of Patent: Oct. 8, 1991

[54] COLD CATHODE FIELD EMISSION DEVICE HAVING AN ELECTRODE IN AN ENCAPSULATING LAYER

[75] Inventor: Robert C. Kane, Woodstock, Ill.

[73] Assignee: Motorola, Inc., Schaumburg, Ill.

[21] Appl. No.: 441,027

[22] Filed: Nov. 22, 1989

[51] Int. Cl.[5] ..... H01J 19/24

[52] U.S. Cl. ..... 445/50; 445/24; 313/336

[58] Field of Search ..... 445/24, 50; 437/80; 313/309, 336

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,894,332 | 7/1975 | Nathanson et al. | 437/3 |
| 3,921,022 | 11/1975 | Levine | 313/309 |
| 3,970,887 | 7/1976 | Smith et al. | 313/309 |
| 3,998,678 | 12/1976 | Fukase et al. | 313/309 |
| 4,008,412 | 2/1977 | Yuito et al. | 313/309 |
| 4,178,531 | 12/1979 | Alig | 313/309 |
| 4,307,507 | 12/1981 | Gray et al. | 445/50 |
| 4,513,308 | 4/1985 | Greene et al. | 313/309 |
| 4,578,614 | 3/1986 | Gray et al. | 313/309 |
| 4,685,996 | 8/1987 | Busta et al. | 313/309 |
| 4,721,885 | 1/1988 | Brodie | 313/576 |
| 4,827,177 | 5/1989 | Lee et al. | 313/306 |
| 4,874,981 | 10/1989 | Spindt | 313/309 |

FOREIGN PATENT DOCUMENTS

| | | |
|---|---|---|
| 0172089 | 7/1985 | European Pat. Off. . |
| 2604823 | 10/1986 | France . |
| 855782 | 6/1977 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM.

Advanced Technology: Flat Cold-Cathode CRTs, by Ivor Brodie, Information Display 1/89.

Field-Emitter Arrays Applied to Vacuum Flourescent Display, by Spindt et al., Jan. 1989 issue of IEEE Transactions on Electronic Devices.

Field Emission Cathode Array Development for High--Current Density Applications by Spindt et al., dated Aug. 1982, vol. 16 of Applications of Surface Science.

*Primary Examiner*—Kenneth J. Ramsey

*Attorney, Agent, or Firm*—Steven G. Parmelee

[57] ABSTRACT

A cold cathode field emission device (100) having an encapsulating layer (109) formed through a low angle vapor deposition process. The encapsulation layer (109) includes an electrode (111). Depending upon the embodiment, the electrode can function as an anode (312) or as a gate (111).

4 Claims, 2 Drawing Sheets

COLD CATHODE FIELD EMISSION DEVICE HAVING AN ELECTRODE IN AN ENCAPSULATING LAYER

TECHNICAL FIELD

This invention relates generally to cold cathode field emission devices.

BACKGROUND OF THE INVENTION

Cold cathode field emission devices are known. Such devices typically comprise a solid state device including a cathode that emits electrons. The electrons move through vacuum to an appropriate anode. Movement of the electrons is governed, at least in part, by a gate electrode (or electrodes) when so provided.

The attributes and potential benefits that may be attained through use of cold cathode field emission devices of this type are known. Notwithstanding this appreciation, however, widespread use of such devices has not occurred, primarily due to significant manufacturing difficulties that are encountered when constructing such a device. Accordingly, a need exists for improved geometries and manufacturing methodologies to support construction of such devices.

SUMMARY OF THE INVENTION

Pursuant to this invention, a cathode structure is provided, and then encapsulated within a substantially evacuated chamber through provision of an encapsulation layer. More particularly, the encapsulation layer is applied through use of a low angle vapor deposition process, wherein the encapsulating layer includes an electrode formed therein.

In one embodiment, this electrode serves as an anode. In another embodiment, this electrode serves as a gate. This electrode structure can be used in conjunction with a variety of cathode structures.

BEST MODE FOR CARRYING OUT THE INVENTION

Figure 1:
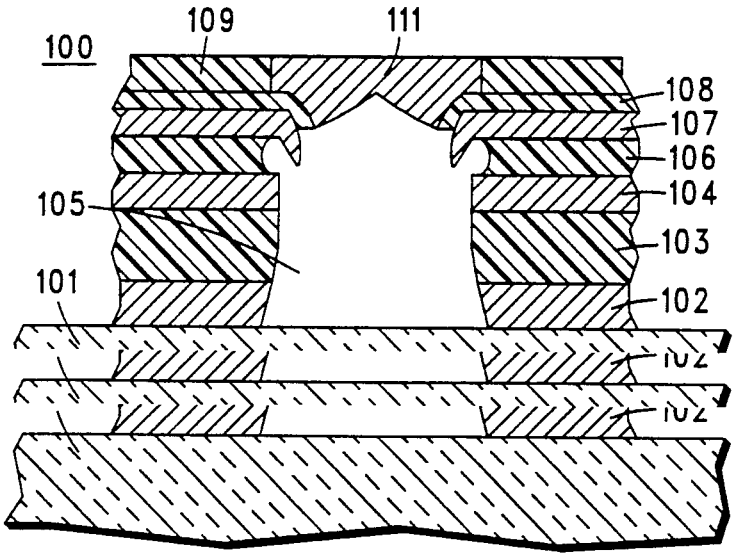
FIG. 1 comprises a side elevational sectioned view of one embodiment constructed in accordance with the invention.

A first embodiment of a field emission device (100) constructed in accordance with the invention is depicted in FIG. 1. In this embodiment, a substrate (101) supports, in sequential layers, an anode (102), an insulating layer (103), a first gate (104), a second insulating layer (106), and a cathode (107). These layers are provided through a series of deposition and etching steps, which processes are well understood in the art. For additional details regarding construction of these particular layers, see Flat Panel Display Using Field Emission Devices, U.S. Ser. No. 07/414,836, filed on Sept. 29, 1989 by Robert Kane and assigned to Motorola, Inc., which document is incorporated herein by this reference.

To provide the requisite evacuated chamber (105), the device (100) also includes an encapsulation layer.

The encapsulation layer is provided through use of a low angle vapor deposition process, which process is well understood in the art. An insulating layer (108) is first deposited (in a vacuum), in order to insulate the cathode (107) from the electrode that will next be formed. Following this step, conductive material may be substituted for the insulating material and the low angle vapor deposition process continued. This will complete the encapsulation of the chamber (105), while simultaneously forming a conductive element (111). Unwanted portions of the conductive material can then be etched away, and insulating material (109) deposited therein. This will leave a conductive element (111) that can serve, in this embodiment, as a second gate to further refine control of the electrons emitted from the cathode (107).

Figure 2:
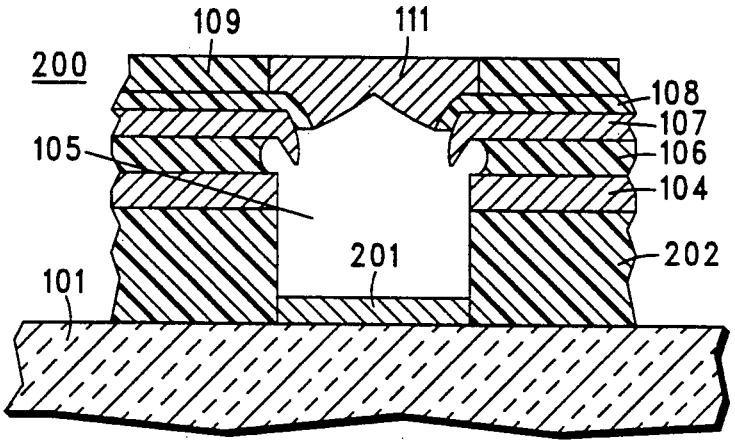
FIG. 2 comprises a side elevational sectioned view of a second embodiment constructed in accordance with the invention.

A second embodiment of a field emission device (200) constructed in accordance with the invention is depicted in FIG. 2. In this figure, the anode (201) is situated at the bottom of the evacuated chamber (105). Aside from this difference, the structure is identical to that described above with respect to FIG. 1. Again, in this embodiment, the electrode (111) formed in the encapsulating layer functions as an additional gate.

A method of constructing a field emission device having a cone shaped cathode and an encapsulation layer that integrally includes an electrode in accordance with the invention will now be described.

Figure 3:
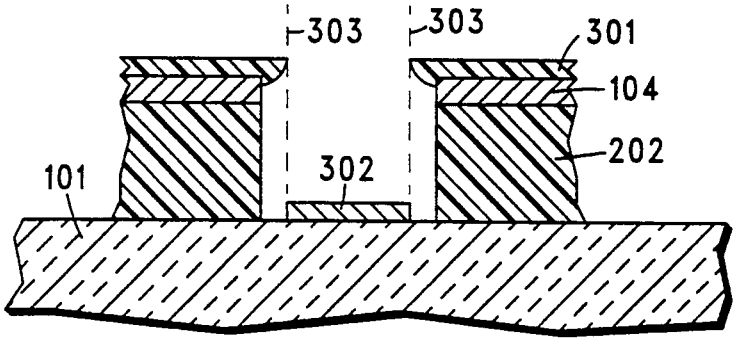
FIGS. 3–7 comprise a series of side elevational depictions of structure resulting from steps that yield a third embodiment of the invention.

A substrate (101) (FIG. 3) provides a suitable support platform. Insulating layers (202) are formed through use of an appropriate deposition process. A gate electrode (104) can then be formed through a metallization deposition process, following which unwanted metallization, such as between the insulating materials, can be removed through an appropriate etching process.

Low angle vapor deposition techniques can then be employed to begin providing an encapsulating layer (301). As the encapsulating layer is formed, the opening to the chamber will constrict (303). Concurrent deposition of a metallization layer within the chamber will therefore be restricted somewhat with respect to the size of the opening (303).

Figure 4:
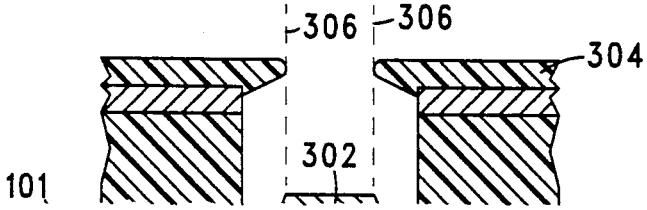
Figure 5:
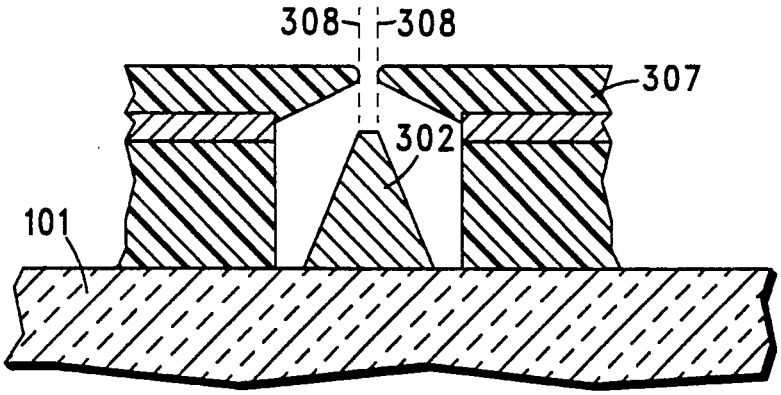
Figure 6:
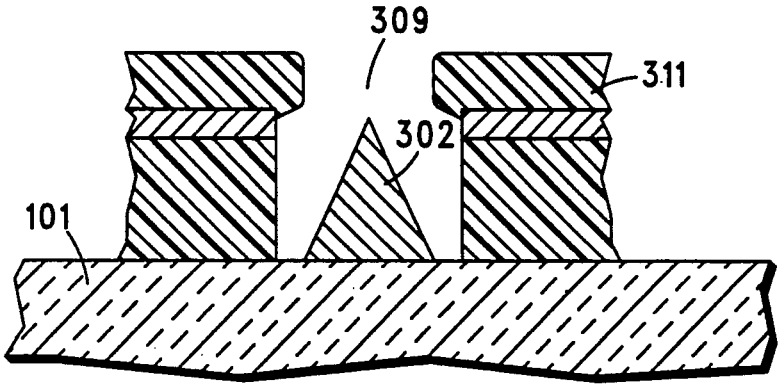
Figure 7:
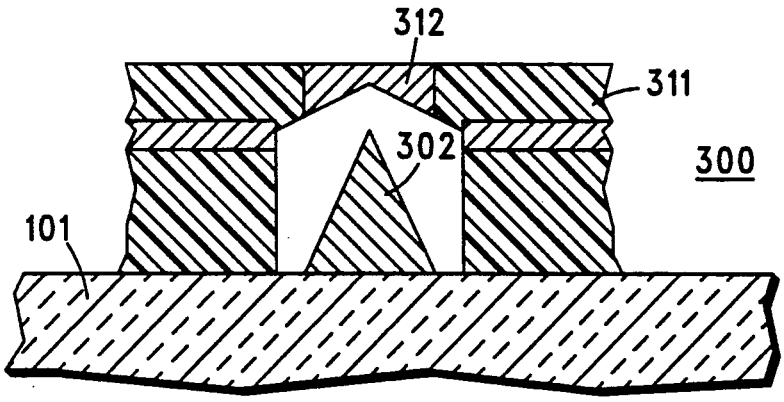

As this process continues (see FIGS. 4 and 5), the opening (306 and 308) will continue to close, and the continued metallization layers will become smaller in cross section, thereby constructing a cone shaped cathode (302). When the cone shaped cathode (302) has been formed, an etching process can be utilized to reopen, to some extent, the encapsulation layer (311) (FIG. 6). The low angle vapor deposition process can then be used with a conductive material to form an electrode (312) integral to the encapsulation layer (FIG. 7). (In the alternative, the encapsulation layer may be so tainted with conductive material, that all of the encapsulation layer is removed. The low angle vaper deposition process would then be used to first build up an insulating layer, and then used to construct the electrode). This yields a third embodiment of the invention (300) wherein the electrode (312) formed within the encapsulation layer (311) functions as the anode for the resultant field emission device (300).

In all of the above embodiments, an encapsulation layer for the field emission device is formed through a low angle vapor deposition process, and in all of the embodiments the encapsulation layer includes an electrode. In some embodiments the electrode functions as a gate, and in others the electrode functions as an anode.

What is claimed is:

1. A method of providing a cold cathode field emission device, comprising the steps of:

A) providing a cathode structure;

B) providing a first portion of an encapsulating layer through low angle vapor deposition of insulating material;

C) providing a second portion of the encapsulating layer through low angle vapor depostion of conductive material; such that the cathode structure is encapsulated within a substantially evacuated chamber, wherein the encapsulating layer includes an electrode formed therein.

2. The method of claim 1 wherein the step of providing a cathode structure includes providing a substantially cone-shaped cathode.

3. The method of claim 1 wherein the electrode comprises an anode.

4. The method of claim 1 wherein the electrode comprises a gate for controlling emission from the cathode.

* * * * *